US009030365B2

(12) United States Patent
Sung et al.

(10) Patent No.: US 9,030,365 B2
(45) Date of Patent: May 12, 2015

(54) WIRELESS COMMUNICATION DEVICE

(71) Applicants: Kun-Lin Sung, New Taipei (TW); Ting-Chih Tseng, New Taipei (TW); Yen-Hui Lin, New Taipei (TW)

(72) Inventors: Kun-Lin Sung, New Taipei (TW); Ting-Chih Tseng, New Taipei (TW); Yen-Hui Lin, New Taipei (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 269 days.

(21) Appl. No.: 13/653,439

(22) Filed: Oct. 17, 2012

(65) Prior Publication Data

US 2014/0009345 A1 Jan. 9, 2014

(30) Foreign Application Priority Data

Jul. 6, 2012 (TW) ..... 101124422 A

(51) Int. Cl.
*H01Q 13/10* (2006.01)
*H01Q 1/24* (2006.01)

(52) U.S. Cl.
CPC ..... *H01Q 13/10* (2013.01); *H01Q 1/243* (2013.01)

(58) Field of Classification Search
CPC ..... H01Q 13/10; H01Q 13/18
USPC ..... 343/767, 770
See application file for complete search history.

(56) References Cited

U.S. PATENT DOCUMENTS 8,489,162 B1 * 7/2013 Dou et al. ..... 455/575.7
2012/0326936 A1 * 12/2012 Tu ..... 343/767

* cited by examiner

*Primary Examiner* — Robert Karacsony
(74) *Attorney, Agent, or Firm* — Novak Druce Connolly Bove + Quigg LLP

(57) ABSTRACT

A wireless communication device includes a metal housing, a baseboard, and a current feed member electronically connected to the baseboard to obtain an electrical current from the baseboard. The housing defines a first notch and a second notch communicating with the first notch. The housing couples with the current feed member, such that the first notch and the second notch both induce the electrical current to excite two resonance modes, the two resonance modes enabling the wireless communication device to receive and transmit first wireless signals and second wireless signals having different central frequencies.

12 Claims, 4 Drawing Sheets

WIRELESS COMMUNICATION DEVICE

BACKGROUND

1. Technical Field

The present disclosure relates to wireless communication devices.

2. Description of Related Art

Antennas are important elements of wireless communication devices (such as mobile phones). Many wireless communication devices employ metal housings. The metal housings that are in contact with baseboards of the wireless communication devices form large grounding points, which reduces radiation efficiency of the antennas. Therefore, antennas in wireless communication devices employing metal housings achieve less than optimal antenna radiation efficiency.

Therefore, there is room for improvement within the art.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawings like reference numerals designate corresponding parts throughout the views.

DETAILED DESCRIPTION

Figure 1:
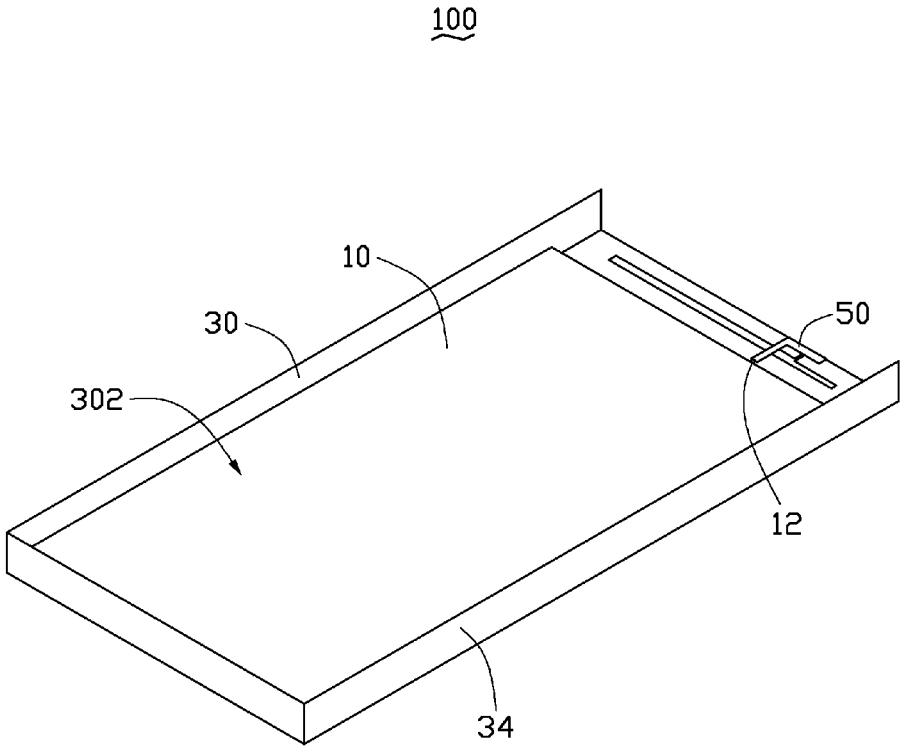
FIG. 1 is an isometric view of a wireless communication device in accordance with an exemplary embodiment.

FIG. 1 shows an exemplary embodiment of a wireless communication device 100. The wireless communication device 100 may be a mobile phone or a personal digital assistant, for example. The wireless communication device 100 includes a baseboard 10, a housing 30, and a current feed member 50.

In the exemplary embodiment, the baseboard 10 is a printed circuit board (PCB) of the wireless communication device 100 and can be made of composite material composed of woven fiberglass cloth with an epoxy resin binder, such as trade name material FR4. The baseboard 10 comprises a feed point 12 that provides an electrical current and a grounding area (not shown) for grounding.

Figure 2:
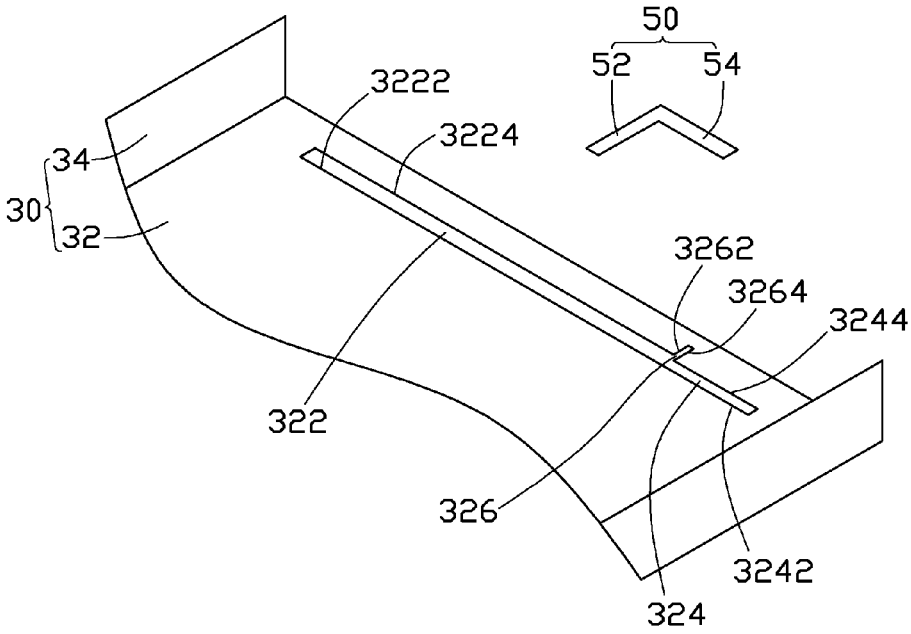
FIG. 2 is a partially disassembled perspective view of the wireless communication device of FIG. 1.
Figure 3:
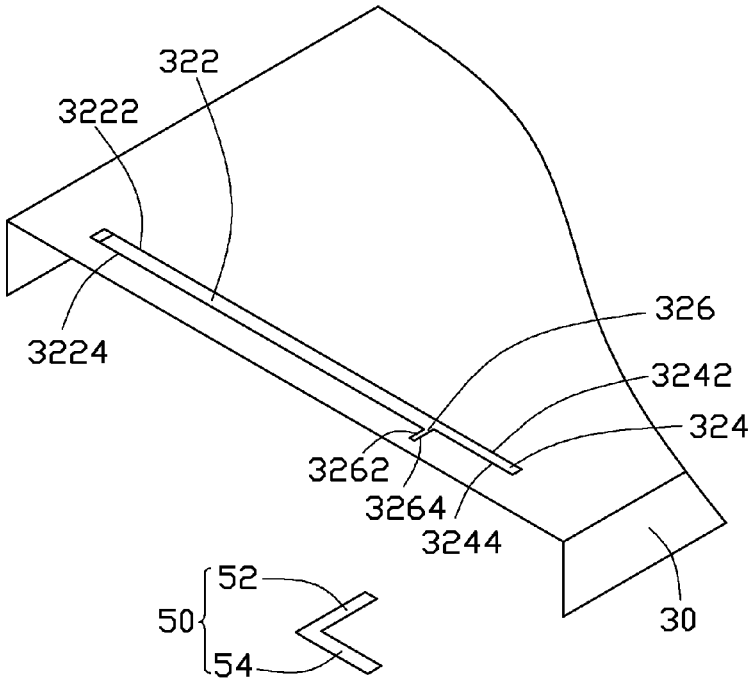
FIG. 3 is similar to FIG. 2 but viewed from another angle.

Referring to FIGS. 1-3, the housing 30 is made of metal. The housing 30 includes a bottom wall 32 and two sidewalls 34. The two sidewalls 34 are opposite to each other and connect with two ends of the bottom wall 32, respectively. The bottom wall 32 and the two sidewalls 34 cooperatively surround a receiving space 302 to receive the baseboard 10 and the current feed member 50.

The baseboard 32 is used as a radiator of an antenna of the wireless communication device 100. The baseboard 32 defines a first notch 322, a second notch 324, and a connecting notch 326. The first notch 322 is substantially rectangular shaped and includes two opposite first sidewalls 3222, 3224. The second notch 324 is substantially rectangular shaped and communicates with the first notch 322. The second notch 324 includes two opposite second sidewalls 3242, 3244. In the exemplary embodiment, length of the first notch 322 is greater than length of the second notch 324. Width of the first notch 322 is greater than width of the second notch 324. The first sidewall 3222 is collinear with the second sidewall 3242, while the first sidewall 3224 is parallel to the second sidewall 3244. One end of the connecting notch 326 communicates with the first and second notches 322, 324 at a junction of the first and second notches 322, 324, thereby enabling the bottom wall 32 to form an open-ended antenna. The connecting notch 326 includes two opposite third sidewalls 3262, 3264. The third sidewall 3262 connects with and is perpendicular to the first sidewall 3224 of the first notch 322. The third sidewall 3264 connects with and is perpendicular to the second sidewall 3244. In one exemplary embodiment, the first notch 322 has a width of about 1.5 mm. The second notch 324 has a width of about 1 mm. The connecting notch 326 has a width of about 0.5 mm. The lengths of the first and second notches 322, 324 can be decreased by increasing the width of the connecting notch 326.

The sidewalls 34 are both electronically connected to the grounding area of the baseboard 10. Thus, the electrical current provided by the baseboard 10 flows through the bottom wall 32, the sidewalls 34, and back to the baseboard 10 to form a circuit.

The current feed member 50 is located above the bottom wall 32 and spaced from the bottom wall 32 by a distance of about 0.4 mm to couple with the bottom wall 32, thereby the current feed member 50 and the bottom wall 32 cooperatively form an antenna of the wireless communication device 100. In one exemplary embodiment, the current feed member 50 is substantially an L-shaped micro-strip line having a first feed portion 52 and a second feed portion 54. An end of the first feed portion 52 is electronically connected to the feed point 12 of the baseboard 10 to obtain electrical current from the baseboard 10. The first feed portion 52 perpendicularly crosses over an end of the first notch 322 near the second notch 324. The second feed portion 54 extends perpendicularly from another end of the first feed portion 52 away from the feed point 12 and crosses over the connecting notch 326.

Figure 4:
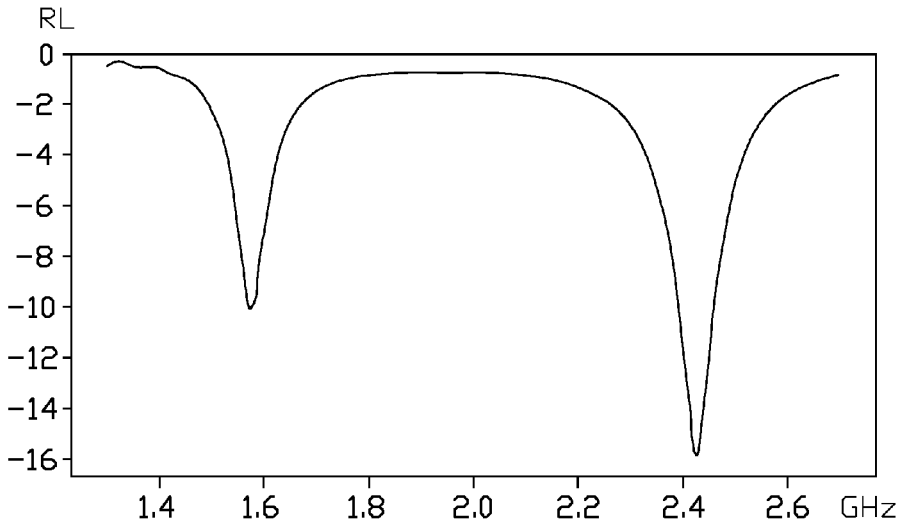
FIG. 4 is a return loss (RL) graph of the wireless communication shown in FIG. 1.

In principal, when the electrical current is fed into the current feed member 50 from the feed point 12, the current feed member 50 couples with the bottom wall 32, enabling all the first notch 322, the second notch 324, and the connecting notch 326 to induce the electrical current. The electrical current flows through the sidewalls 34 to the grounding area of the baseboard 10 to form a circuit. The current strength around the first notch 322 and the second notch 324 is greater than other regions of the bottom wall 32, enabling the first notch 322 to excite a first resonance mode to receive and transmit first wireless signals and enabling the second notch 324 to excite a second resonance mode to receive and transmit second wireless signals. FIG. 4 shows that when the wireless communication device 100 is used to receive and transmit wireless communication signals in central frequencies of 1570-1575 MHz and 2400-2484 MHz, the wireless communication device 100 has a high receiving and transmitting efficiency.

The housing 30 of the wireless communication device 100 comprises the first and second notches 322, 324 defined in the bottom wall 32, enabling the bottom wall 32 of the housing 30 to perform as an antenna radiator to receive and transmit the first and second wireless signals having different central frequencies.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A wireless communication device, comprising:

a metal housing, the housing defining a first notch, a second notch communicating with the first notch, and a connecting notch communicating with both the first and second notches; the first notch comprising two first sidewalls opposite to each other; the second notch comprising two second sidewalls opposite to each other; one of the first sidewalls is collinear with one of the second sidewalls and the other first sidewall is not collinear with but parallel to the other second sidewall;

a baseboard; and a current feed member electronically connected to the baseboard to obtain an electrical current from the baseboard;

wherein the housing couples with the current feed member, such that the first notch and the second notch both induce the electrical current to excite two resonance modes, the two resonance modes enabling the wireless communication device to receive and transmit first wireless signals and second wireless signals having different central frequencies;

the current feed member comprises a first feed portion and a second feed portion;

the first feed portion perpendicularly crosses over an end of the first notch near the second notch with an end of the first feed portion electronically connected to the baseboard; and the second feed portion extends perpendicularly from another end of the first feed portion away from the feed point and crosses over the connecting notch.

2. The wireless communication device as claimed in claim 1, wherein the housing comprises a bottom wall and two sidewalls; the first and second notches are both defined in the bottom wall; the two sidewalls are opposite to each other and connect with two ends of the bottom wall, respectively, such that the bottom wall and the two sidewalls cooperatively surround a receiving space that receives the baseboard and the current feed member.

3. The wireless communication device as claimed in claim 2, wherein the baseboard comprises a feed point; the current feed member is electronically connected to the feed point.

4. The wireless communication device as claimed in claim 2, wherein the sidewalls are electronically connected to the baseboard.

5. The wireless communication device as claimed in claim 2, wherein the current feed member is located above the bottom wall and spaced from the bottom wall to couple with the bottom wall, such that the current feed member and the bottom wall cooperatively form an antenna of the wireless communication device.

6. The wireless communication device as claimed in claim 1, wherein a length of the first notch is greater than a length of the second notch; a width of the first notch is greater than a width of the second notch.

7. The wireless communication device as claimed in claim 1, wherein the connecting notch includes two third sidewalls opposite to each other; the third sidewalls respectively connect with and are perpendicular to one of the first sidewalls and one of the second sidewalls which are parallel to each other.

8. A wireless communication device, comprising:

a metal housing, the housing defining a first notch, a second notch communicating with the first notch, and a connecting notch communicating with both the first and second notches;

the first notch comprising two first sidewalls opposite to each other; the second notch comprising two second sidewalls opposite to each other; one of the first sidewalls is collinear with one of the second sidewalls and the other first sidewall is not collinear with but parallel to the other second sidewall;

a baseboard; and a current feed member electronically connected to the baseboard to obtain an electrical current from the baseboard;

wherein the housing couples with the current feed member to cooperatively form an antenna of the wireless communication device, the first notch and the second notch both induce the electrical current to excite resonance modes, enabling the wireless communication device to receive and transmit wireless signals;

the current feed member comprises a first feed portion and a second feed portion;

the first feed portion perpendicularly crosses over an end of the first notch near the second notch with an end of the first feed portion electronically connected to the baseboard; and the second feed portion extends perpendicularly from another end of the first feed portion away from the feed point and crosses over the connecting notch.

9. The wireless communication device as claimed in claim 8, wherein a length of the first notch is greater than a length of the second notch; a width of the first notch is greater than a width of the second notch.

10. The wireless communication device as claimed in claim 8, wherein the connecting notch includes two third sidewalls opposite to each other; the third sidewalls respectively connect with and are perpendicular to one of the first sidewalls and one of the second sidewalls which are not collinear with each other.

11. The wireless communication device as claimed in claim 8, wherein the housing comprises a bottom wall and two sidewalls; the first and second notches both are defined in the bottom wall; the two sidewalls are opposite to each other and connect with two ends of the bottom wall, respectively, thereby the bottom wall and the two sidewalls cooperatively surrounding a receiving space that receives the baseboard and the current feed member.

12. The wireless communication device as claimed in claim 11, wherein the current feed member is located above the bottom wall and spaced from the bottom wall to couple with the bottom wall, such that the current feed member and the bottom wall cooperatively form an antenna of the wireless communication device.

* * * * *